US010196111B2

(12) United States Patent
De Carvalho E Silva et al.

(10) Patent No.: US 10,196,111 B2
(45) Date of Patent: Feb. 5, 2019

(54) GRAVITATION ANCHOR FOR OFFSHORE ANCHORING OF SHIPS AND PLATFORMS

(71) Applicants: PETROLEO BRASILEIRO S.A.—PETROBRAS, Rio de Janeiro (BR); UNIVERSIDADE FEDERAL DO RIO DE JANEIRO, Rio de Janeiro (BR)

(72) Inventors: Daniel Fonseca De Carvalho E Silva, Rio de Janeiro (BR); Marcos Donato Auler Da Silva Ferreira, Rio de Janeiro (BR); Antonio Carlos Fernandes, Rio de Janeiro (BR)

(73) Assignees: PETROLEO BRASILEIRO S.A.—PETROBRAS, Rio de Janeiro (BR); UNIVERSIDADE FEDERAL DO RIO DE JANEIRO, Rio de Janeiro (BR)

( * ) Notice: Subject to any disclaimer, the term of this patent is extended or adjusted under 35 U.S.C. 154(b) by 0 days.

(21) Appl. No.: 15/354,627

(22) Filed: Nov. 17, 2016

(65) Prior Publication Data

US 2017/0144731 A1 May 25, 2017

(30) Foreign Application Priority Data

Nov. 23, 2015 (BR) ..... 10 2015 029208-2

(51) Int. Cl.
*B63B 21/29* (2006.01)
*B63B 21/26* (2006.01)
(Continued)

(52) U.S. Cl.
CPC ..... *B63B 21/26* (2013.01); *B63B 21/38* (2013.01); *B63B 2021/265* (2013.01); *E02D 5/80* (2013.01); *E02D 5/803* (2013.01)

(58) Field of Classification Search
CPC ..... B63B 21/36; B63B 2021/265; E02D 5/80
See application file for complete search history.

(56) References Cited

U.S. PATENT DOCUMENTS 3,279,136 A * 10/1966 Smith ..... E02D 5/54 405/244
3,282,002 A * 11/1966 Jefferson ..... B63B 21/26 52/162

(Continued)

FOREIGN PATENT DOCUMENTS

EP 1 042 162 B1 7/2003

*Primary Examiner* — Andrew Polay
(74) *Attorney, Agent, or Firm* — Sughrue Mion, PLLC

(57) ABSTRACT

The present invention is related to a gravitation anchor for offshore anchoring of ships and platforms, comprising a main body (10) with a longitudinal axis of revolution (11), comprising a means of stabilization (14), whereby the means of stabilization (14) comprises a means of automatic activation (140). Optionally, the means of stabilization comprises at least one stabilizer (14), whereby each stabilizer (14) comprises an end pivotally attached (141) to the gravitation anchor (1), and a free end, whereby when the stabilizer (14) is in a retracted position, the free end is positioned closer to the main body (10) of the gravitation anchor (1), and whereby when the stabilizer (14) is in an extended position, the free end is positioned away from the main body (10) of the gravitation anchor (1).

9 Claims, 5 Drawing Sheets

(51) Int. Cl.
*E02D 5/80* (2006.01)
*B63B 21/38* (2006.01)

(56) References Cited

U.S. PATENT DOCUMENTS 4,798,159 A * 1/1989 Taylor ..... B63B 21/44
114/295
7,059,263 B1 * 6/2006 Zimmerman ..... B63B 21/243
114/301

* cited by examiner

GRAVITATION ANCHOR FOR OFFSHORE ANCHORING OF SHIPS AND PLATFORMS

CROSS REFERENCE TO RELATED APPLICATIONS

This application is claims priority based on Brazilian Patent Application No. 10 2015 029208-2 filed Nov. 23, 2015, the contents of which are incorporated herein by reference in their entirety.

INVENTION FIELD

The present invention is for a gravitation anchor, also known as a torpedo anchor, used for anchoring ships and offshore platforms. More specifically, the invention is for a gravitation anchor that has hydrodynamic stabilizers.

BASIS OF THE INVENTION

During the anchoring process of offshore oil platforms, a device known as a gravitation anchor or torpedo anchor is commonly used. Such a device is cast at a certain height from the seabed to gain speed, due to the gravitational pull during its descent to reach the seabed. Thus, the gravitation anchor hits the seabed at a high speed, causing it to have a higher load capacity and thus provide greater embedding into the seabed.

FIG. 1 shows a schematic representation of the procedure described above, whereby a gravitation anchor 1 is ready for casting. In this procedure, gravitation anchor 1 is connected to a first end 2*a* of anchor line 2, wherein anchor line 2 is suspended from a second end 2*b*, with the aid of an auxiliary casting line 3*a* connected to the platform 4 to be anchored.

In addition, anchor line 2 is suspended by an intermediate point, with the aid of a second auxiliary casting line 3*b*, by an auxiliary vehicle 5. Anchor 1 is then positioned at a specific height and released for free fall until it reaches the seabed 6, being embedded.

The first auxiliary casting line 3*a* is then retracted until anchor line 2 reaches platform 4 and is connected thereto. Thus, platform 4 is anchored. Preferably, more than one anchor is used at different points of platform 4.

In order to increase the stability of the anchor during the fall, and consequently increase its final speed, it is desirable that the anchor stay as close as possible in a vertical direction. However, the geometric shape and the mass distribution of the stake are mainly designed for it to fulfill its geotechnical function, that is, after being embedded in seabed 6, which could adversely affect its stability during the fall to the seabed 6.

Consequently, stabilization of the anchor during the fall is often hindered, which can cause it to reach seabed 6 with high inclines, thus reducing its capacity and load, and causing embedding in seabed 6 to be more superficial. For this reason, often the anchor must be removed and reinstalled, or the use of a new anchor is required.

The prior art provides some solutions to increase the stability of gravitation anchors, as described by document EP1042162B1, which shows an anchor body, part of which has a polygonal or circular shape, a point and a rod projecting up, whereby the rod has a lower average density than the main body of the anchor. Thus, the anchor body is shaped such that the center of gravity is in the lower part thereof, and below the average distance of the sum of all fluid forces, which ensures directional stability.

Document EP1042162B1 also shows the use of fins to prevent rotation of the body during its descent. The attached fins shown in this document, however, may pose an obstacle to penetration of the anchor in the seabed, which could lead to the same problem described above, namely insufficient embedding of the anchor in the seabed.

Document U.S. Pat. No. 7,059,263B1, in turn, shows an anchor for anchoring structures into the seabed, comprising an elongated central body, which has a longitudinal axis through its center. A plurality of nose and tail plates are placed within channels, and hinged to the central body, so that the plates can swing inward or outward with respect to the central body, and then may be attached in the desired place. A means for attaching an anchor line 2 is also provided.

Also, as defined by document U.S. Pat. No. 7,059,263B1, the use of an arm in an approximately central region of the central anchor body is provided. This arm causes momentum in the anchor, causing the nose thereof to be kept pointed down (vertically). For this, the arm must be positioned and attached by pins before using the anchor.

The pin shown in document U.S. Pat. No. 7,059,263B1 should be installed only at the time that the anchor is used, so as to prevent damage from being caused to the equipment during transport. Thus, this solution requires rework on the anchor before it is cast, which may cause delays in the procedure. In addition, installation of the arm described is done manually, meaning that human error could cause a malfunction of the device.

Thus, it is clear that the prior art lacks a means of stabilizing a gravitation anchor that does not require rework prior to use, that does not negatively interfere with the anchor's load capacity and that does not require manual labor in order to function correctly.

SUMMARY OF THE INVENTION

The present invention is primarily intended to provide a gravitation anchor 1 comprising a means of stabilization that does not require pre-casting reworking and does not require manual labor in order to function correctly.

Thus, in order to achieve this objective, the present invention provides a gravitation anchor for offshore anchoring of ships and platforms, comprising a main body with a longitudinal axis of rotation, comprising a means of stabilization, whereby the means of stabilization comprises automatic activation.

BRIEF DESCRIPTION OF THE FIGURES

The detailed description below makes reference to the accompanying figures and their respective reference numbers, representing embodiments of the present invention.

DETAILED DESCRIPTION OF THE INVENTION

Preliminarily, it is emphasized that the following description will start with a preferred embodiment of the invention, applied to a gravitation anchor 1. However, as will be apparent to one skilled in the art, changes in the object described may be made within the scope of protection of the invention.

Figure 1:
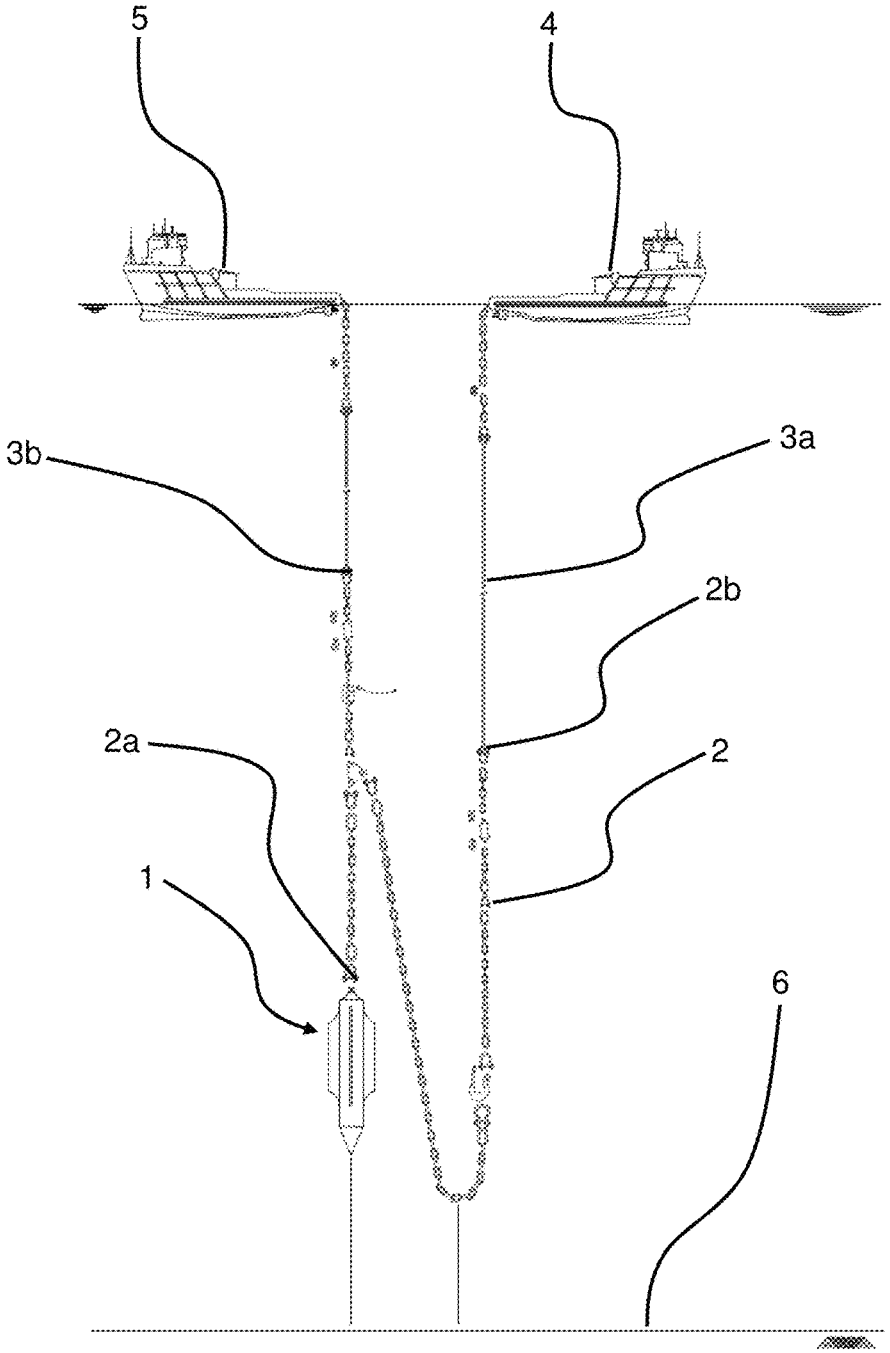
FIG. 1 illustrates a schematic representation of the procedure for installation of a traditional gravitation anchor.

The present invention relates to the improvement of gravitation anchors as illustrated in FIG. 1, whereby a schematic representation of the installation of a traditional gravitation anchor 1 is shown, whereby the gravitation anchor 1 is ready to be cast. In this procedure, the gravitation anchor 1 is connected to a first end 2*a* of an anchor line 2, in which the anchor line 2 is suspended from a second end 2*b*, with the aid of an auxiliary casting line 3*a* connected to the platform 4 to be anchored.

In addition, anchor line 2 is suspended by an intermediate point, with the aid of a second auxiliary casting line 3*b*, by an auxiliary vehicle 5. The anchor is then positioned at a specific height and released for free fall until it reaches the seabed 6, being embedded.

The first auxiliary casting line 3*a* is then retracted until anchor line 2 reaches platform 4 and is connected thereto. That is how the platform 4 is anchored. Preferably, more than one anchor 1 is used at different points.

The present invention provides a gravitation anchor comprising means of stabilization 14 to stabilize the downward movement of the anchor, increasing its speed and its load capacity, and enabling deeper embedding of anchor 1 when it hits the seabed 6.

Figure 2:
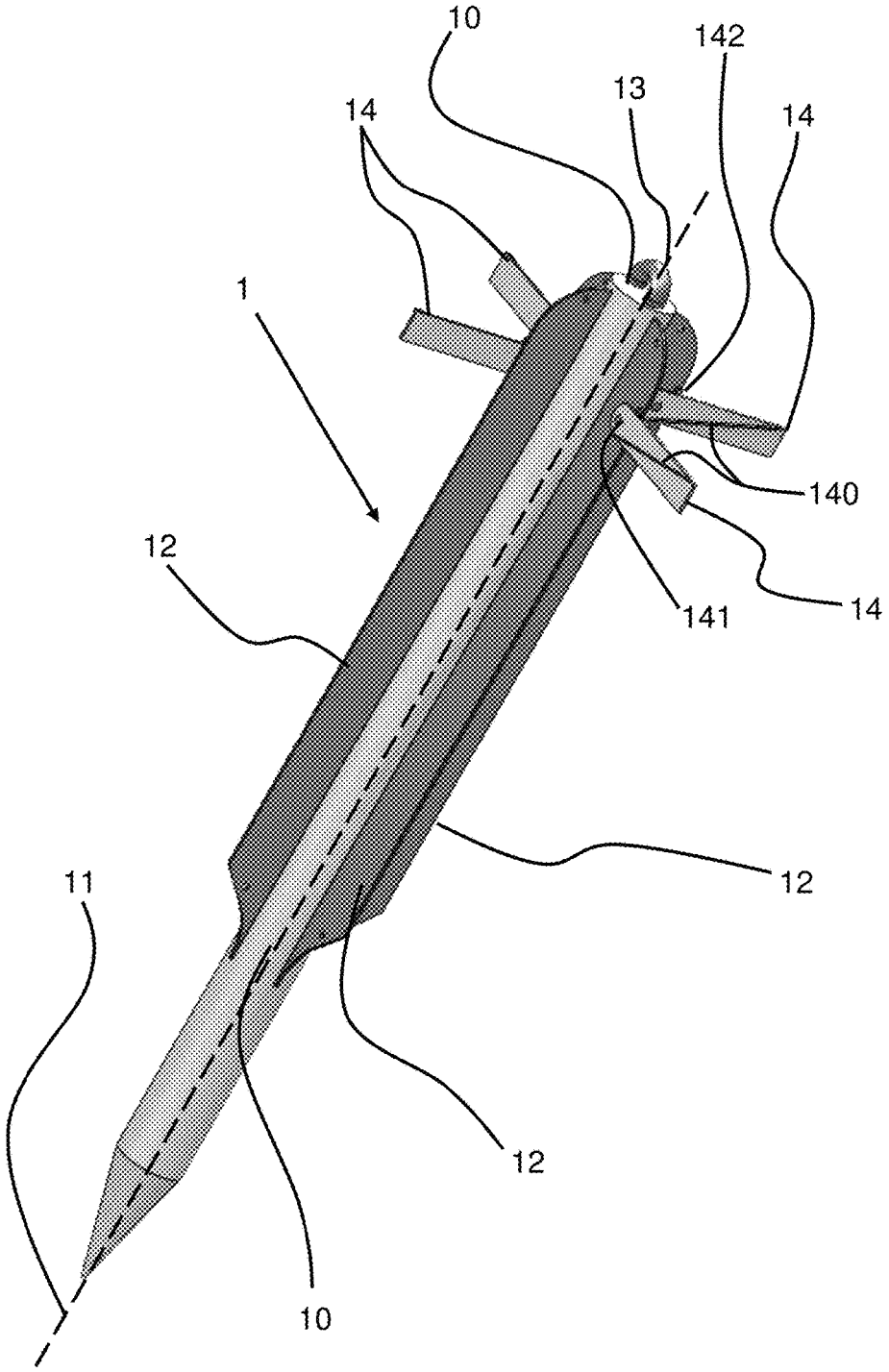
FIG. 2 illustrates a view of a gravitation anchor as defined by an optional embodiment of the present invention.

FIG. 2 illustrates a view of a gravitation anchor 1 as defined by an optional embodiment of the present invention, wherein it comprises means for its stabilization 14, optionally attached on its upper portion.

Optionally, the anchor comprises a main body 10 with a longitudinal axis of revolution 11, whereby the main body 10 comprises fins 12 in at least one portion of its length. Preferably, at least two fins 12 are adopted, preferably three fins 12, and more preferably four fins 12.

Optionally, the gravitation anchor 1 comprises a connector element 13 for connection to an anchor line 2 at its upper end.

Figure 3:
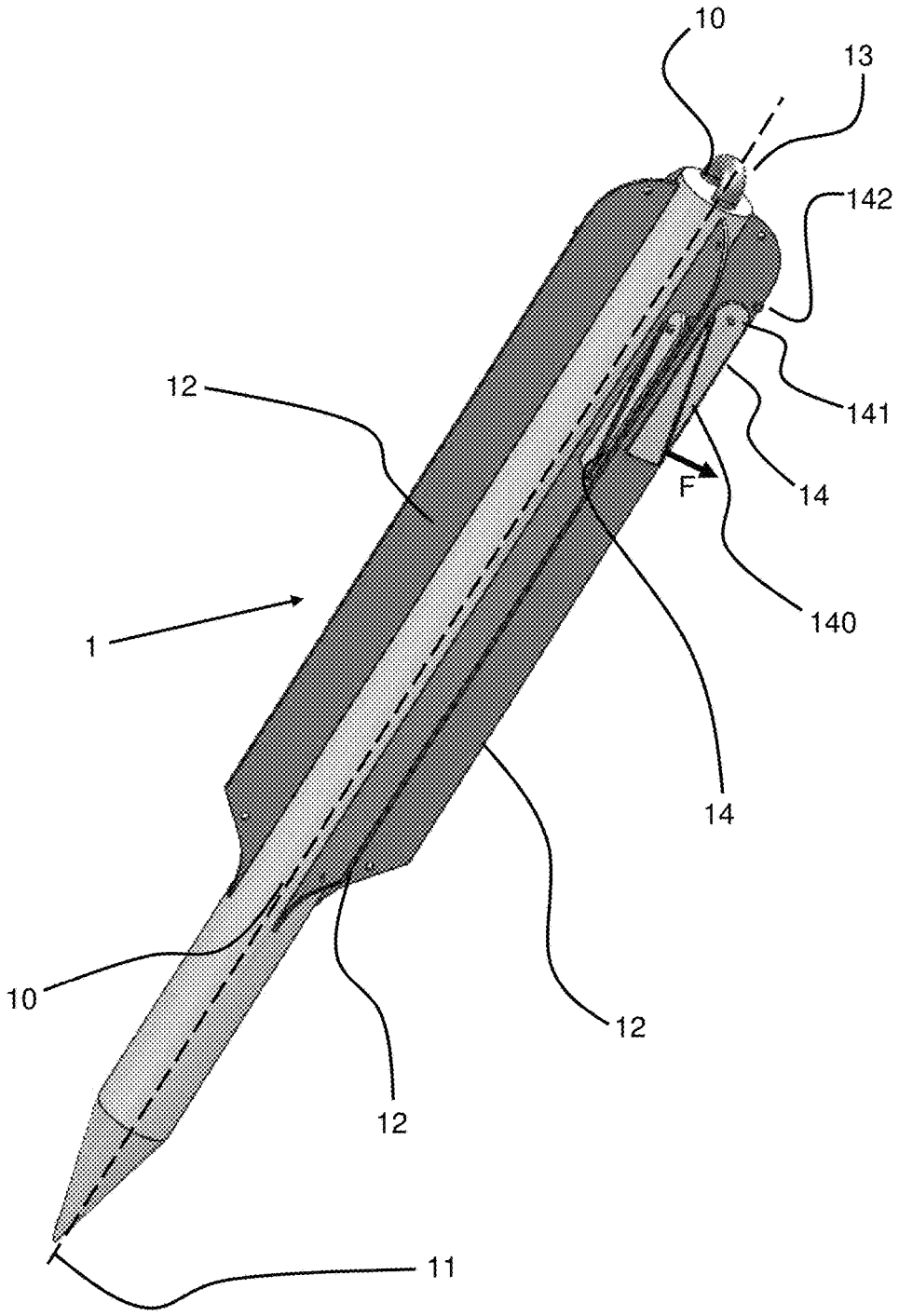
FIG. 3 illustrates a view of the gravitation anchor in FIG. 2, as defined by an optional embodiment, whereby the means of stabilization is retracted.
Figure 4:
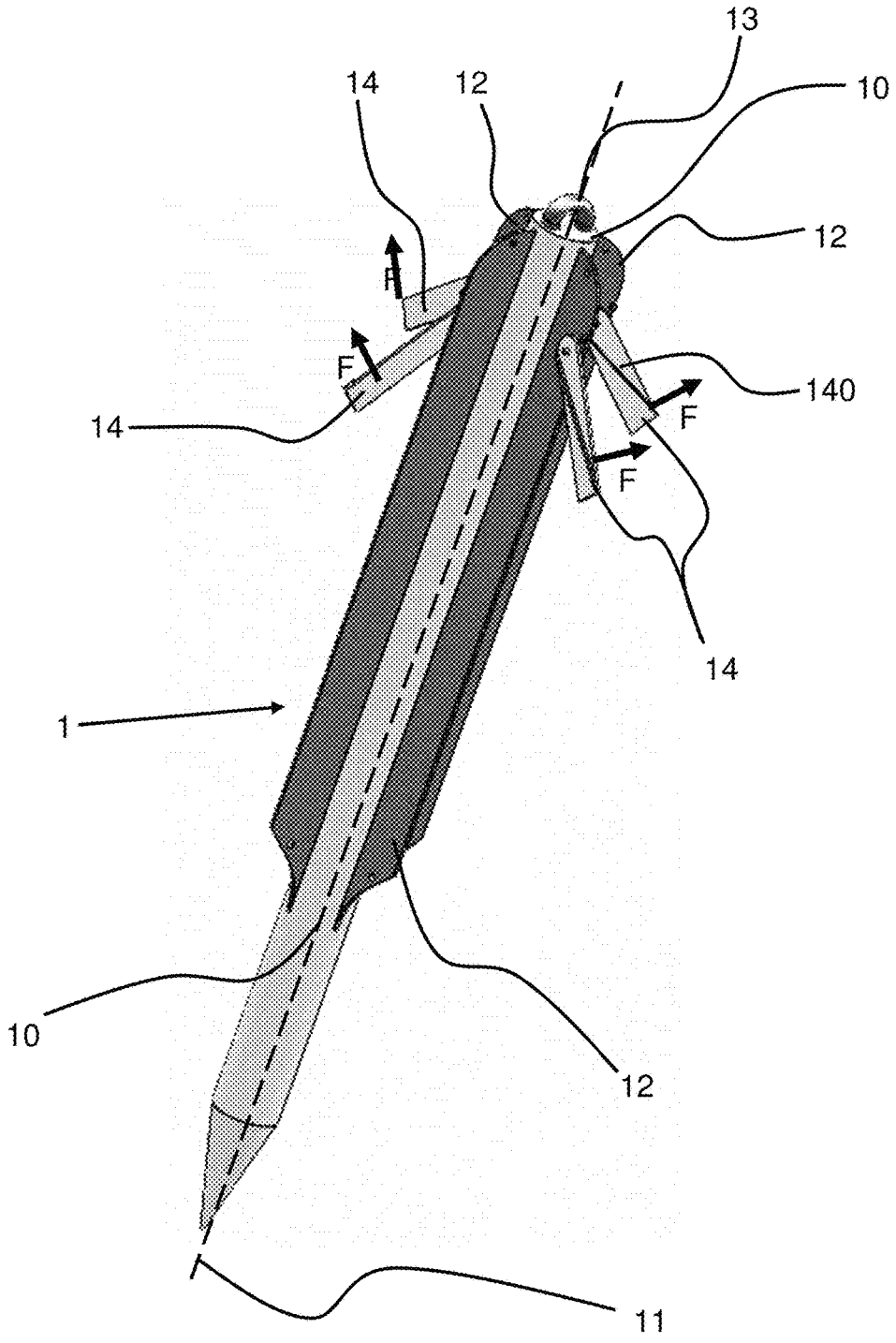
FIG. 4 illustrates a view of the gravitation anchor in FIG. 2, whereby the means of stabilization is moving into the final position of use.

FIG. 3 illustrates a view of gravitation anchor 1 of the present invention, as defined by an optional embodiment, whereby the means of stabilization 14 is retracted. FIG. 4 illustrates a view of gravitation anchor 1 of the present invention, as defined by an optional embodiment, whereby the means of stabilization 14 is moving into the final position of use.

Preferably, the means of stabilization 14 comprises at least one stabilizer 14, whereby each stabilizer 14 comprises an end pivotally attached 141 to the gravitation anchor 1 and a free end, so that when the means of stabilization 14 is in its retracted position, the free end is positioned closer to the main body 10 of the gravitation anchor 1. In turn, when the means of stabilization 14 is in its extended position, the free end is positioned away from the main body 10 of the gravitation anchor 1. Optionally, the stabilizer 14 comprises a rigid plate.

Optionally, each stabilizer 14 is attached in a coplanar fashion on a fin of the gravitation anchor 1. As shown, each fin comprises a stabilizer 14; however, other embodiments are provided. For example, the number of stabilizers 14 may be greater than the number of fins 12, whereby each fin comprises more than one stabilizer 14, or the number of stabilizers 14 is less than the number of fins 12.

As defined by the present invention, the means for stabilizing the gravitation anchor comprises a means of automatic activation 140, so that each means of stabilization 14 is automatically activated when the gravitation anchor 1 is positioned to be cast or when it is immersed in water and starts to move.

Figure 5:
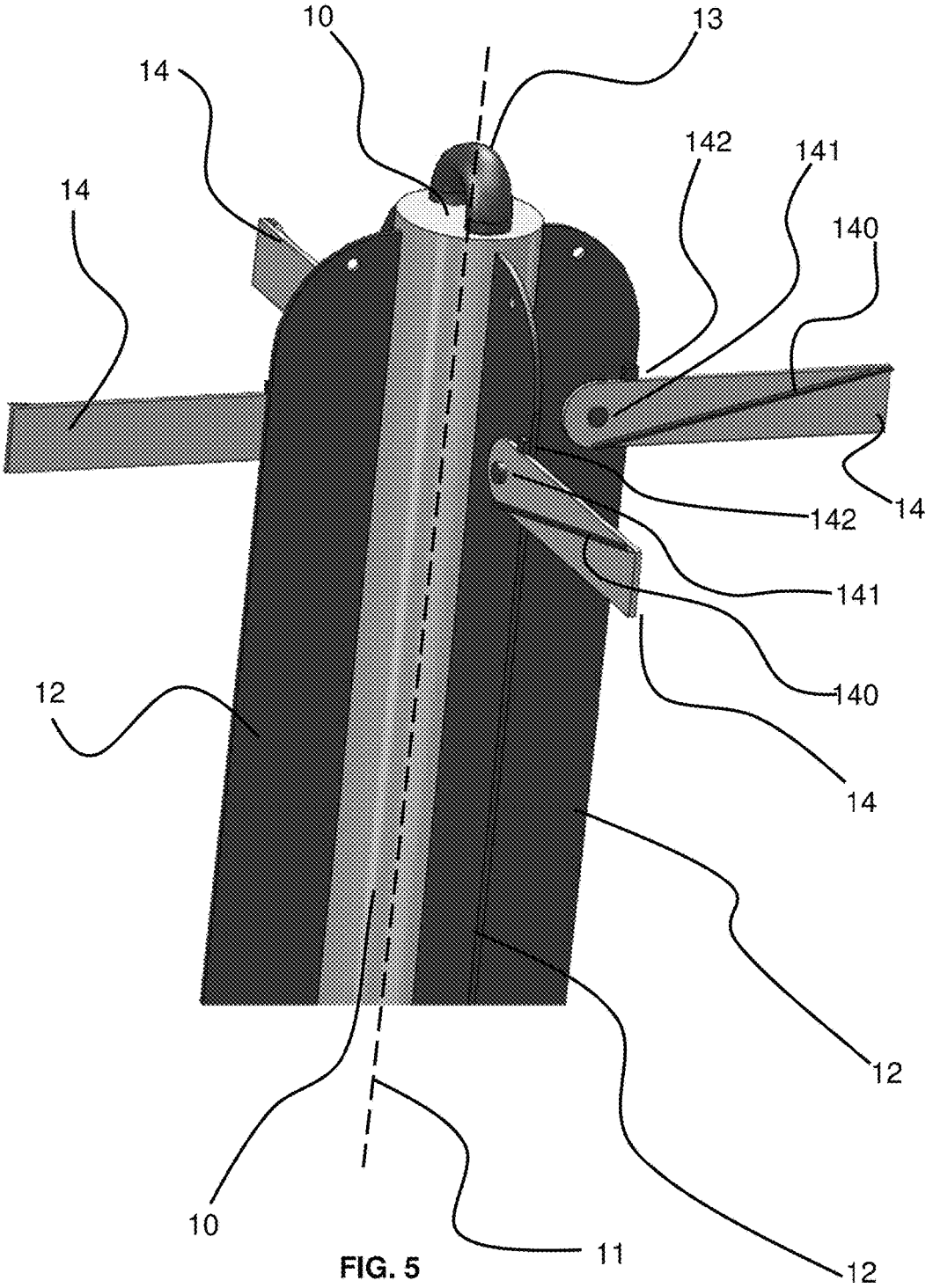
FIG. 5 illustrates a detailed view of the means of stabilization illustrated in FIG. 2.

As can be best seen in FIG. 5, which illustrates in detail the means of stabilization 14 illustrated in FIGS. 2, 3 and 4, the means of automatic activation 140 of each stabilizer 14 is formed by a protrusion in at least one of the faces of the stabilizer 14, whereby the protrusion 140 may be formed by a jut in the stabilizer 14 itself, or by an element attached to the stabilizer 14, such as a plate. Thus, when the gravitation anchor 1 starts the downward movement into the water, hydrodynamic forces F will boost each stabilizer 14, causing them to rotate around an axis that is pivotally attached 141.

Optionally, so as to optimize the hydrodynamic forces mentioned, the protrusion 140 is positioned along at least one surface of the stabilizer 14, whereby when the stabilizer 14 is in its retracted position, illustrated in FIG. 3, the protrusion moves away from the axis of revolution 11 of the gravitation anchor 1, approaching the free end of the stabilizer 14.

Note that other embodiments of means of automatic activation 140 can, however, be adopted, staying within the scope of protection of the present invention. Merely as an example, alternatively, the means of automatic activation 140 may comprise a system of cables whereby the stabilizer 14 is activated and positioned in its position of use by gravitational force, when the gravitation anchor 1 is suspended. Other embodiments can also be adopted.

Optionally, the gravitation anchor 1 comprises a stroke limiting element 142 of the stabilizer 14, adapted to limit the rotation stroke of the stabilizer 14, defining the final position thereof.

As illustrated by the optional embodiment of FIGS. 2, 3, 4 and 5, the stroke limiting element 142 is a pin attached to the fin where the respective stabilizer 14 is attached.

Optionally, the gravitation anchor 1 comprises a locking element (not shown), adapted for locking each stabilizer 14 in its final position, preventing it from going back to its retracted position, once it reaches its final position of use.

Optionally, in order to prevent the means of stabilization 14 from negatively interfering with the load capacity of the gravitation anchor 1 of the present invention, it can be designed to detach from the gravitation anchor 1 upon impact with the seabed 6. Such detachment may take place by a break in the means of stabilization 14 itself, or a break in the element responsible for attaching the means of stabilization 14 to the gravitation anchor 1.

Thus, the present invention provides a gravitation anchor 1 comprising means of stabilization 14, without requiring rework for positioning the means of stabilization 14. As such, it allows the anchor to reach a higher final speed, which increases its load capacity and thus provides deeper embedding thereof into the seabed.

In addition, when the embodiment in which the means of stabilization 14 is designed to detach from the gravitation anchor 1 at the time of impact against the seabed 6 is adopted, it minimizes the possible negative impact of the means of stabilization 14 on the embedding of the gravitation anchor 1, increasing the effect of its use.

The invention claimed is:

1. A gravitation anchor (1) for offshore anchoring of ships and platforms, comprising a main body (10) having a longitudinal axis of revolution (11), and at least one stabilizer (14), the at least one stabilizer (14) comprising an end pivotally attached (141) to the gravitation anchor, and a free end;

wherein the at least one stabilizer (14) further comprises a protrusion formed on at least one face of the at least one stabilizer (14), wherein the protrusion automatically activates the at least one stabilizer;

wherein when the at least one stabilizer (14) is activated, the at least one stabilizer (14) moves from a retracted position, wherein the free end is positioned closer to the main body (10) of the gravitation anchor (1), to an extended position, wherein the free end is positioned away from the main body (10) of the gravitation anchor (1);

wherein when the at least one stabilizer (14) is activated, the at least one stabilizer pivotally rotates in a direction toward a rearward end of the gravitation anchor (1);

wherein the protrusion is positioned along at least one surface of the at least one stabilizer (14);

wherein when the at least one stabilizer (14) is in the retracted position, the protrusion is formed so as to extend away from the axis of revolution (11) of the gravitational anchor (1) as the protrusion reaches the free end of the at least one stabilizer (14); and wherein the protrusion extends from the at least one surface of the at least one stabilizer (14) in a direction perpendicular to the direction in which the at least one stabilizer (14) pivotally rotates.

2. The gravitation anchor (1), according to claim 1, wherein the main body (10) of the gravitation anchor (1) comprises fins (12) disposed on at least one portion of its length.

3. The gravitation anchor (1), according to claim 1, further comprising at least three fins (12).

4. The gravitation anchor (1), according to claim 1, further comprising a connector element (13) connecting to an anchor line (2) at an upper end thereof.

5. The gravitation anchor (1), according to claim 1, wherein the at least one stabilizer (14) comprises a rigid plate.

6. The gravitation anchor (1), according to claim 1, wherein the at least one stabilizer (14) is attached to a fin of the gravitation anchor (1).

7. The gravitation anchor (1), according to claim 1, wherein the at least one stabilizer (14) comprises a stroke limiting element (142), which limits a rotation stroke of the at least one stabilizer (14) and sets the final position thereof.

8. The gravitation anchor (1), according to claim 1, wherein the at least one stabilizer (14) detaches from the gravitation anchor (1) upon impact against a seabed (6).

9. The gravitation anchor (1), according to claim 7, wherein the stroke limiting element (142) is a pin attached to a fin where the at least one stabilizer (14) is attached.

* * * * *